US010854972B2

(12) United States Patent
Chou et al.

(10) Patent No.: US 10,854,972 B2
(45) Date of Patent: Dec. 1, 2020

(54) MULTIPLE-FREQUENCY ANTENNA DEVICE

(71) Applicant: UNICTRON TECHNOLOGIES CORPORATION, Hsinchu County (TW)

(72) Inventors: Chih-Shen Chou, Hsinchu County (TW); Tsung-Shou Yeh, Hsinchu County (TW); Hsiang-Cheng Yang, Hsinchu County (TW); Pei-Jen Lin, Hsinchu County (TW)

(73) Assignee: Unictron Technologies Corporation, Hsin-Chu (TW)

( * ) Notice: Subject to any disclaimer, the term of this patent is extended or adjusted under 35 U.S.C. 154(b) by 0 days.

(21) Appl. No.: 16/426,021

(22) Filed: May 30, 2019

(65) Prior Publication Data

US 2019/0372222 A1 Dec. 5, 2019

(30) Foreign Application Priority Data

Jun. 1, 2018 (TW) ..... 107119055 A

(51) Int. Cl.

| | |
|---|---|
| ***H01Q 1/22*** | (2006.01) |
| ***H01Q 5/10*** | (2015.01) |
| ***H01Q 5/314*** | (2015.01) |
| ***H01Q 1/38*** | (2006.01) |
| ***H01Q 23/00*** | (2006.01) |
| ***H01Q 5/50*** | (2015.01) |

(52) U.S. Cl.

CPC ..... *H01Q 5/10* (2015.01); *H01Q 1/2283* (2013.01); *H01Q 1/38* (2013.01); *H01Q 5/314* (2015.01); *H01Q 5/50* (2015.01); *H01Q 23/00* (2013.01)

(58) Field of Classification Search

CPC ..... H01Q 1/38; H01Q 1/243; H01Q 1/2283; H01Q 5/50; H01Q 5/314; H01Q 5/335

See application file for complete search history.

(56) References Cited

U.S. PATENT DOCUMENTS

| | | | | |
|---|---|---|---|---|
| 10,090,593 | B2 * | 10/2018 | Chou | H01Q 5/335 |
| 2008/0174508 | A1 * | 7/2008 | Iwai | H01Q 21/28 343/850 |
| 2011/0156963 | A1 * | 6/2011 | Rajgopal | H01P 1/203 343/702 |
| 2013/0241798 | A1 * | 9/2013 | Lee | H01Q 1/243 343/876 |
| 2019/0372199 | A1 * | 12/2019 | Haridas | H03H 7/0115 |

* cited by examiner

*Primary Examiner* — Tung X Le
(74) *Attorney, Agent, or Firm* — Winston Hsu

(57) ABSTRACT

A multiple-frequency antenna device includes an antenna unit and a frequency switch unit. The antenna unit includes an insulating substrate on which grounded first and second conductive layers are disposed. The first conductive layer is further connected to a radio-frequency (RF) circuit. The frequency switch unit is connected to the antenna unit in parallel, and includes a switching component, and a frequency adjustment: component connected to the antenna unit. The multiple-frequency antenna device is resonant at a first resonant frequency when the switching component is switched to a first state, and is resonant at a different, second resonant frequency when the switching component is switched to a second state.

20 Claims, 9 Drawing Sheets

MULTIPLE-FREQUENCY ANTENNA DEVICE

CROSS-REFERENCE TO RELATED APPLICATION

This application claims priority of Taiwanese Patent Application No. 107119055, filed on Jun. 1, 2018.

FIELD

The disclosure relates to an antenna device, and more particularly to a multiple-frequency antenna device.

BACKGROUND

Recently, modularization and miniaturization are trends in electronic product manufacture. Therefore, a single antenna device that is switchable between different frequency bands so as to be compatible with multiple wireless communication technologies, e.g., Global Positioning System (GPS), Wi-Fi or Bluetooth, in place of multiple antennas for different wireless communication technologies, is demanded.

SUMMARY

Therefore, an object of the disclosure is to provide a multiple-frequency antenna device.

According to one aspect of the disclosure, the multiple-frequency antenna device is adapted to be electrically connected to a radio-frequency (RF) circuit. The multiple-frequency antenna device includes an antenna unit and a frequency switch unit. The antenna unit includes an insulating substrate, a first conductive layer and a second conductive layer. The first conductive layer and the second conductive layer are disposed on the insulating substrate, and are electrically connected to ground respectively via a first ground line and a second ground line. The first conductive layer is further electrically connected to the RF circuit via a feeding line. The frequency switch unit is electrically connected to the antenna unit in parallel via the second ground line and the feeding line. The frequency switch unit includes a first frequency adjustment component and a switching component. The first frequency adjustment component is electrically connected to the antenna unit via the second ground line. The switching component is switchable at least to a first state and to a second state. When the switching component is switched to the first state, the first frequency adjustment component is electrically connected to the antenna unit via the switching component and the feeding line, and the antenna unit and the frequency switch unit are cooperatively resonant at a first resonant frequency. When the switching component is switched to the second state, the first frequency adjustment component is electrically disconnected from the feeding line, and the antenna unit and the frequency switch unit are cooperatively resonant at a second resonant frequency different from the first resonant frequency.

According to another aspect of the disclosure, the multiple-frequency antenna device is adapted to be electrically connected to a radio-frequency (RF) circuit. The multiple-frequency antenna device includes an antenna unit and a frequency switch unit. The antenna unit includes an insulating substrate, a first conductive layer and a second conductive layer. The first conductive layer and the second conductive layer are disposed on the insulating substrate. The first conductive layer is electrically connected to ground via a first ground line, and is further electrically connected to the RF circuit via a feeding line. The second conductive layer is electrically connected to ground via a second ground line. The frequency switch unit includes a first frequency adjustment component, a second frequency adjustment component and a switching component. The first frequency adjustment component is electrically connected to ground. The second frequency adjustment component is electrically connected to ground. The switching component is switchable at least to a first state and to a second state. When the switching component is switched to the first state, the first frequency adjustment component is electrically connected to the antenna unit via to switching component and the second ground line, and the antenna unit and the frequency switch unit are cooperatively resonant at a first resonant frequency. When the switching component is switched to the second state, the second frequency adjustment component is electrically connected to the antenna unit via the switching component and the second ground line, and the antenna unit and the frequency switch unit are cooperatively resonant at a second resonant frequency different from the first resonant frequency.

According to still another aspect of the disclosure, the multiple-frequency antenna device is adapted to be electrically connected to a radio-frequency (RF) circuit. The multiple-frequency antenna device includes an antenna unit and a frequency switch unit. The antenna unit includes an insulating substrate, a first conductive layer, a second conductive layer and a third conductive layer. The first conductive layer, the second conductive layer and the third conductive layer are disposed on the insulating substrate. The first conductive layer and the second conductive layer are electrically connected to ground respectively via a first ground line and a second ground line. The third conductive layer is electrically connected to the RF circuit via a feeding line that is electrically connected to ground via a third ground line. The frequency switch unit is electrically connected to the antenna unit in parallel via the second ground line and the feeding line, and includes a frequency adjustment component and a switching component. The frequency adjustment component is electrically connected to the antenna unit via the second ground line. The switching component is switchable to a first state and to a second state. When the switching component is switched to the first state, the frequency adjustment component is electrically connected to the antenna unit via the switching component and the feeding line, such that the antenna unit and the frequency switch unit are cooperatively resonant at a first resonant frequency, and that the antenna unit is individually resonant at a second resonant frequency different from the first resonant frequency. When the switching component is switched to the second state, the frequency adjustment component is electrically disconnected from the feeding line, the antenna unit and the frequency switch unit are cooperatively resonant at a third resonant frequency different from the first and second resonant frequencies, and the antenna unit is individually resonant at a fourth resonant frequency different from the first, second and third resonant frequencies.

According to further another aspect of the disclosure, the multiple-frequency antenna device is adapted to be electrically connected to a radio-frequency (RF) circuit. The multiple-frequency antenna device includes an antenna unit and a frequency switch unit. The antenna unit includes an insulating substrate, a first conductive layer, a second conductive layer and a third conductive layer. The first conductive layer, the second conductive layer and the third conductive layer are disposed on the insulating substrate. The first conductive layer is electrically connected to ground via a first ground line. The second conductive layer is electrically connected to ground via a second ground line. The third conductive layer is electrically connected to the RF circuit via a feeding line. The feeding line is electrically connected to ground via a third ground line. The frequency switch unit includes a first frequency adjustment component, a second frequency adjustment component and a switching component. The first frequency adjustment component is electrically connected to ground. The second frequency adjustment component is electrically connected to ground. The switching component is switchable to a first state and to a second state. When the switching component is switched to the first state, the first frequency adjustment component is electrically connected to the antenna unit via the switching component and the second ground line, such that the antenna unit and the frequency switch unit are cooperatively resonant at a first resonant frequency, and that the antenna unit is individually resonant at a second resonant frequency different from the first resonant frequency. When the switching component is switched to the second state, the second frequency adjustment component is electrically connected to the antenna unit via the switching component and the second ground line, such that the antenna unit and the frequency switch unit are cooperatively resonant at a third resonant frequency different from the first and second resonant frequencies, and that the antenna unit is individually resonant at a fourth resonant frequency different from the first, second and third resonant frequencies.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
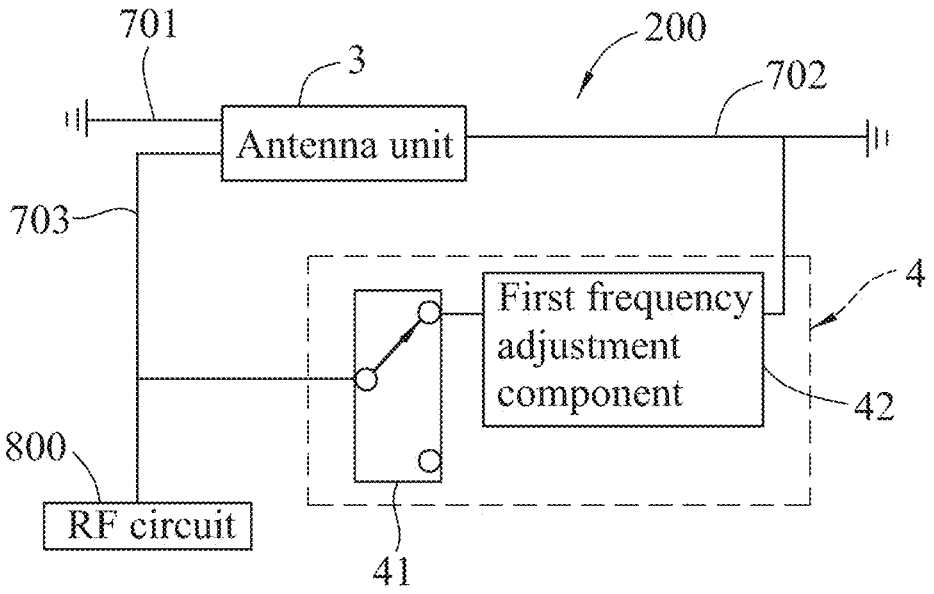
FIG. 1 is a circuit block diagram illustrating a first embodiment of a multiple-frequency antenna device according to the disclosure, a switching component of which is switched to a first state.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
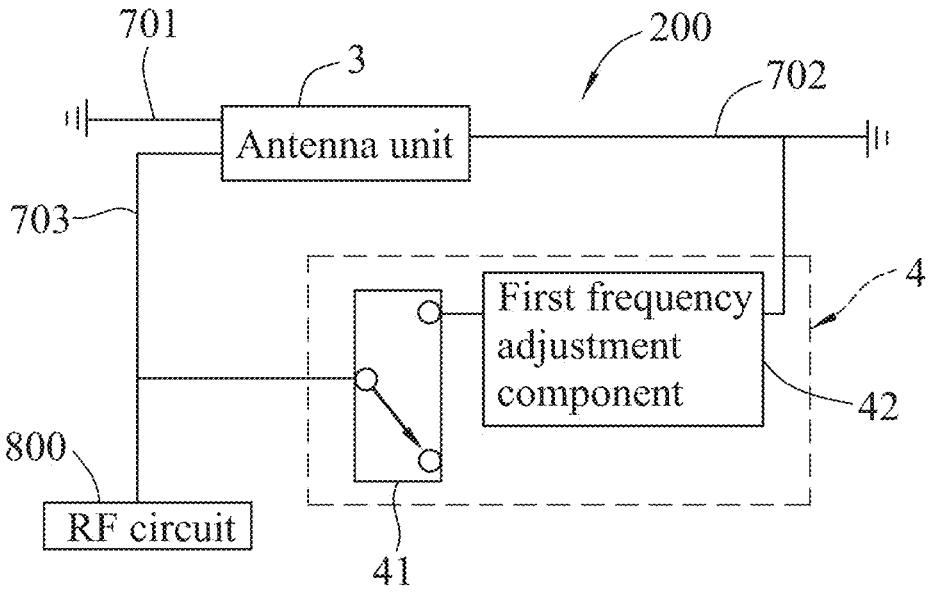
FIG. 2 is a circuit block diagram illustrating the first embodiment with the switching component switched to a second state.
Figure 3:
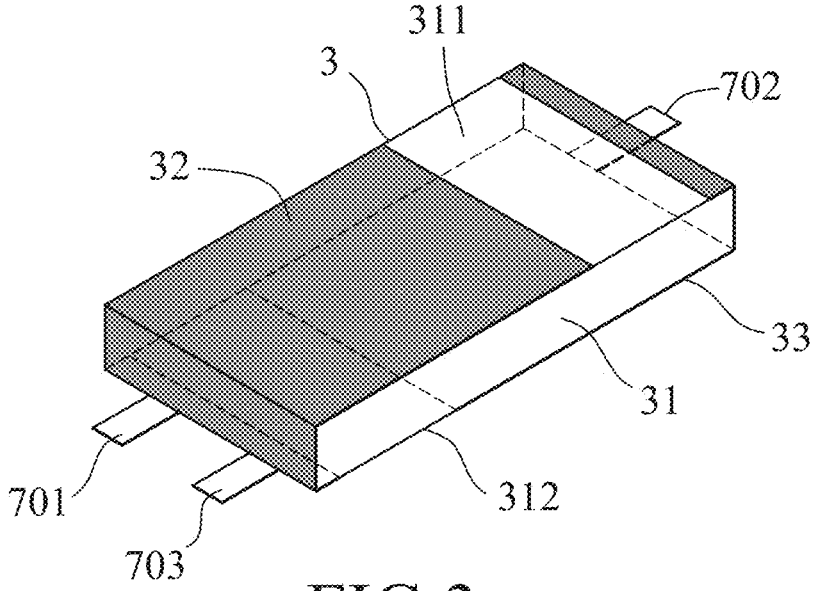
FIG. 3 is a perspective view illustrating an implementation of an antenna unit of the first embodiment.

Referring to FIGS. 1 to 3, a first embodiment of a multiple-frequency antenna device 200 is illustrated. The multiple-frequency antenna device 200 is adapted to be electrically connected to a radio-frequency (RF) circuit 800 of a wireless communication device (not shown). The multiple-frequency antenna device 200 includes an antenna unit 3 and a frequency switch unit 4.

The antenna unit 3 includes an insulating substrate 31, and a first conductive layer 32 and a second conductive layer 33 that are disposed on the insulating substrate 31. Specifically speaking, the insulating substrate 31 has a first surface 311 and a second surface 312 which are opposite to each other. The first conductive layer 32 is disposed on the first surface 311 of the insulating substrate 31. The second conductive layer 33 is disposed on the second surface 312 of the insulating substrate 31. A projection of the first conductive layer 32 on the second surface 312 of the insulating substrate 31 overlaps a portion of the second conductive layer 33, such that capacitive effect is created between the first conductive layer 32 and the second conductive layer 33 and results in a certain resonant frequency of the multiple-frequency antenna device 200. In addition, the first conductive layer 32 and the second conductive layer 33 are electrically connected to ground respectively via a first ground line 701 and a second ground line 702. The first conductive layer 32 is further electrically connected to the RF circuit 800 via a feeding line 703.

The frequency switch unit 4 is electrically connected to the antenna unit 3 in parallel via the second ground line 702 and the feeding line 703. The frequency switch unit 4 includes a switching component 41 and a first frequency adjustment component 42.

The first frequency adjustment component 42 is electrically connected to the antenna unit 3 via the second ground line 702. The switching component 41 is switchable to a first state and to a second state. The first frequency adjustment component 42 may be implemented by passive components such as capacitors, inductors and/or resistors, and the switching component 41 may be implemented to be a switch integrated circuit (IC), but implementations of the first frequency adjustment component 42 and the switching component 41 are not limited to the disclosure herein and may vary in other embodiments.

As shown in FIG. 1, when the switching component 41 is switched to the first state, the first frequency adjustment component 42 is electrically connected to the antenna unit 3 via the switching component 41 and the feeding line 703, and the antenna unit 3 and the frequency switch unit 4 are cooperatively resonant at a first resonant frequency. A value of the first resonant frequency may be adjusted by changing values of the capacitors, the inductors and/or the resistors that are utilized to implement the first frequency adjustment component 42, as to enable the multiple-frequency antenna device 200 to be resonant at a desired value of the first resonant frequency when the multiple-frequency antenna device 200 and the RF circuit 800 are electrically connected.

As shown in FIG. 2, when the switching component 41 is switched to the second state, the first frequency adjustment component 42 is electrically disconnected from the feeding line 703, and the antenna unit 3 and the frequency switch unit. 4 are cooperatively resonant at a second resonant frequency different from the first resonant frequency.

Figure 4:
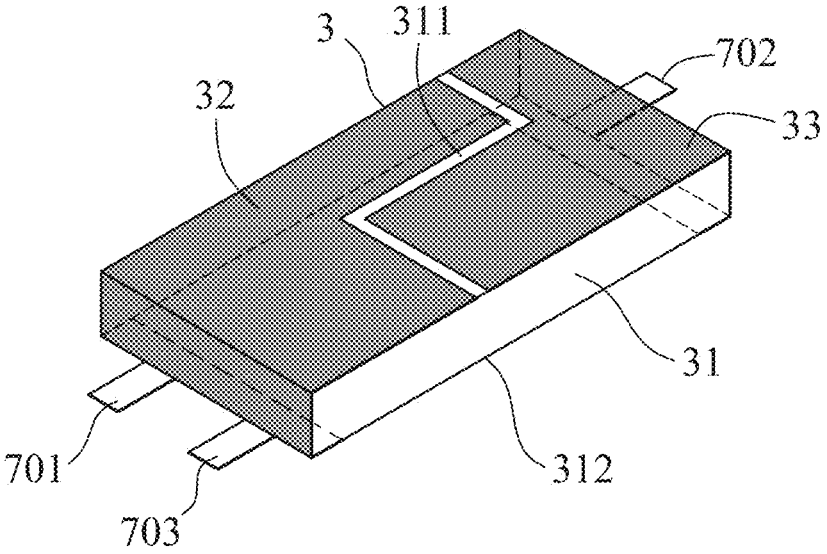
FIG. 4 is a perspective view illustrating another implementation of the antenna unit of the first embodiment.
Figure 5:
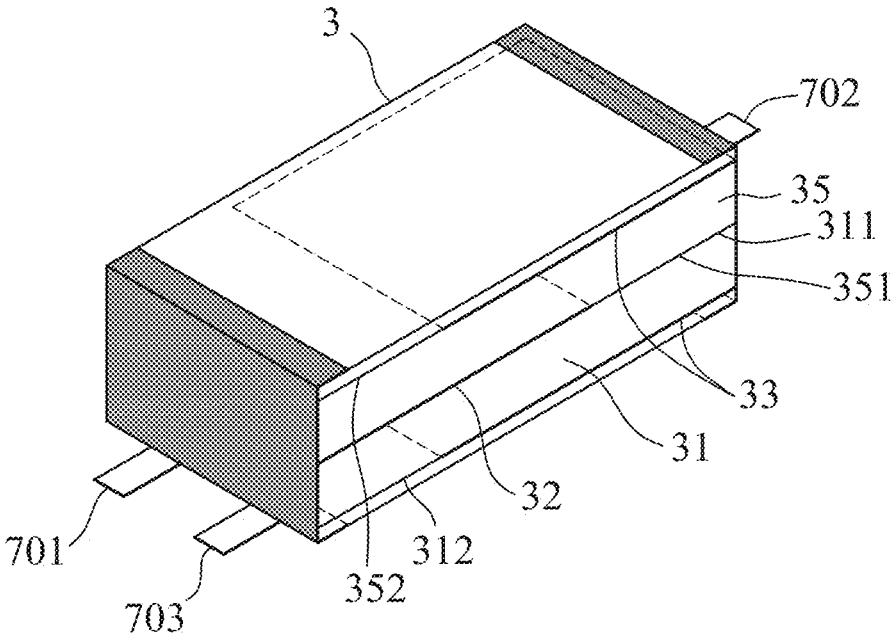
FIG. 5 is a perspective view illustrating still another implementation of the antenna unit of the first embodiment.

In the first embodiment of the multiple-frequency antenna device 200, the first conductive layer 32 and the second conductive layer 33 are respectively disposed on the first surface 311 and the second surface 312 of the insulating substrate 31, as depicted in FIG. 3. However, implementations of shapes and placements of the first conductive layer 32 and the second conductive layer 33 are not limited to the disclosure herein and may vary in other embodiments. For example, as shown in FIG. 4, in a variant of the first embodiment, the first conductive layer 32 and the second conductive layer 33 are both disposed on the first surface 311 of the insulating substrate 31, and are spaced apart from each other. In another variant of the first embodiment as shown in FIG. 5, the antenna unit 3 further includes another insulating substrate 35 having a first surface 351 and a second surface 352; the first conductive layer 32 is sandwiched between the first surfaces 311, 351 of the insulating substrates 31, 35; and two halves of the second conductive layer 33 are respectively disposed on the second surfaces 312, 352 of the insulating substrates 31, 35. A projection of the first conductive layer 32 on the second surface 312 of the insulating substrate 31, and a projection of the first conductive layer 32 on the second surface 352 of the insulating substrate 35 both overlap a portion of the second conductive layer 33.

Figure 6:
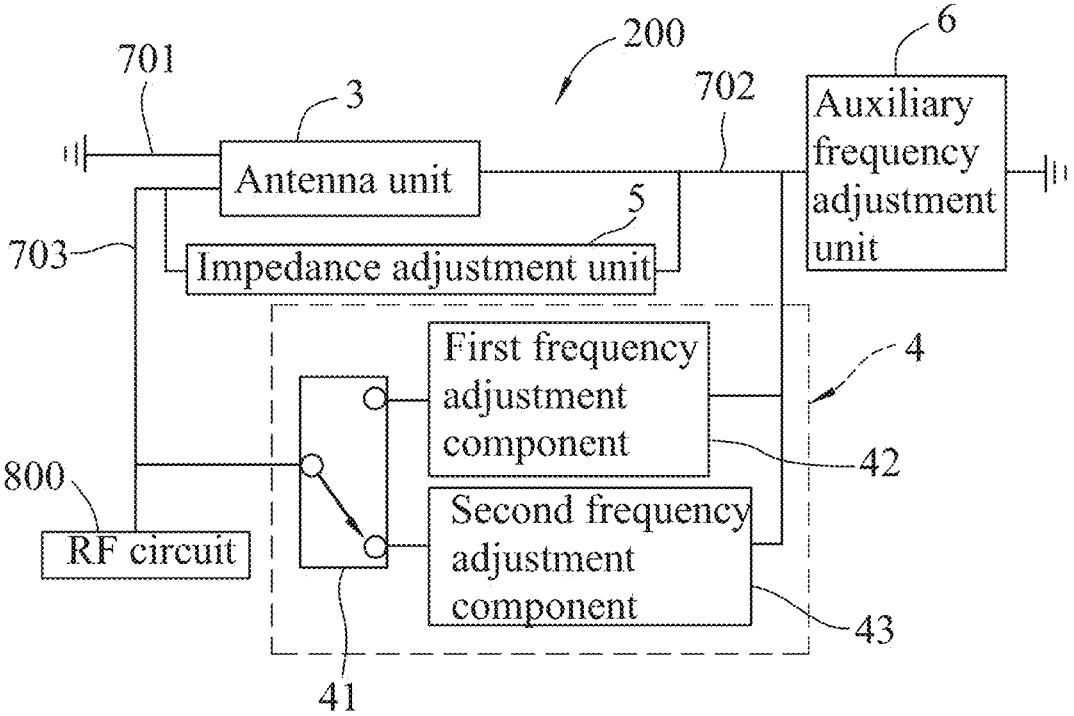
FIG. 6 is a circuit block diagram illustrating a second embodiment of the multiple-frequency antenna device according to the disclosure.

Referring to FIG. 6, a second embodiment of the multiple-frequency antenna device 200 is illustrated. The second embodiment is similar to the first embodiment, but is different in what are described as follows.

The multiple-frequency antenna device 200 of the second embodiment further includes an impedance adjustment unit 5 and an auxiliary frequency adjustment unit 6. It should be noted that the multiple-frequency antenna device 200 may be implemented to include only one of the impedance adjustment unit. 5 and the auxiliary frequency adjustment unit 6, and implementation of the multiple-frequency antenna device 200 is not limited to the disclosure herein and may vary in other embodiments.

The frequency switch unit 4 of the second embodiment further includes a second frequency adjustment component 43 electrically connected to the antenna unit 3 via the second ground line 702. The second frequency adjustment component 43 may be implemented by passive components such as capacitors, inductors and/or resistors, but implementation of the second frequency adjustment component 43 is not limited to the disclosure herein and may vary in other embodiments. When the switching component 41 is switched to the second state, the second frequency adjustment component 43 is electrically connected to the antenna unit 3 via the switching component 41 and the feeding line 703.

The impedance adjustment unit 5 is electrically connected to the antenna unit 3 in parallel via the second ground line 702 and the feeding line 703 so that the an effective impedance and a frequency of the multiple-frequency antenna device 200 can be tuned by the impedance adjustment unit 5.

The auxiliary frequency adjustment unit 6 is electrically connected between the second ground line 702 and ground. The auxiliary frequency adjustment unit 6 is resonant with the antenna unit 3, the frequency switch unit 4 and the impedance adjustment unit 5 at one of the first and second resonant frequencies, and enables adjustment of the first and second resonant frequencies of the multiple-frequency antenna device 200. The auxiliary frequency adjustment unit 6 may be implemented by passive components such as capacitors, inductors and/or resistors, but implementation of the auxiliary frequency adjustment unit 6 is not limited to the disclosure herein and may vary in other embodiments.

When utilizing the multiple-frequency antenna device 200 which is electrically connected to the RF circuit 800, changing values of the capacitors, inductors and/or resistors of the first frequency adjustment component 42, the second frequency adjustment component 43 or the auxiliary frequency adjustment unit 6 enables the first and second resonant frequencies of the multiple-frequency antenna device 200 to be tuned based on demand.

Figure 7:
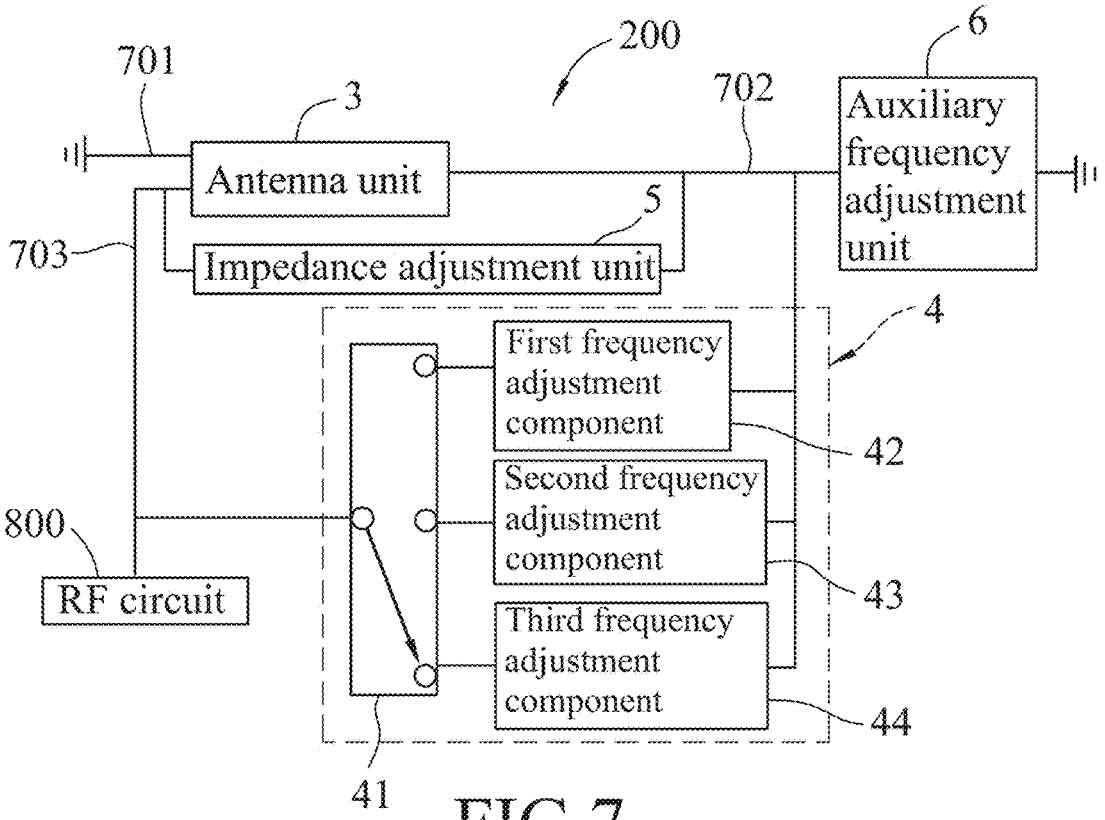
FIG. 7 is a circuit block diagram illustrating a third embodiment of the multiple-frequency antenna device according to the disclosure.

Referring to FIG. 7, a third embodiment of the multiple-frequency antenna device 200 is illustrated. The third embodiment is similar to the second embodiment, but is different in what are described as follows.

Besides the first and second states, the switching component 41 of the third embodiment is switchable further to a third state.

The frequency switch unit 4 of the third embodiment further includes a third frequency adjustment component 44 electrically connected to the antenna unit 3 via the second ground line 702. The third frequency adjustment component 44 may be implemented by passive components such as capacitors, inductors and/or resistors, but implementation of the third frequency adjustment component 44 is not limited to the disclosure herein and may vary in other embodiments.

When the switching component 41 is switched to the third state, the third frequency adjustment component 44 is electrically connected to the antenna unit 3 via the switching component 41 and the feeding line 703; the first frequency adjustment component 42 and the second frequency adjustment component 43 are both electrically disconnected from the feeding line 703; and the antenna unit 3, the frequency switch unit 4, the impedance adjustment unit 5 and the auxiliary frequency adjustment unit 6 are cooperatively resonant at a third resonant frequency different from the first and second resonant frequencies. The third resonant frequency may be adjusted by changing values of the capacitors, inductors and/or resistors that are utilized to implement the third frequency adjustment component 44 and the auxiliary frequency adjustment unit 6. The multiple-frequency antenna device 200 may be switched to operate in one of three resonant frequencies.

Figure 8:
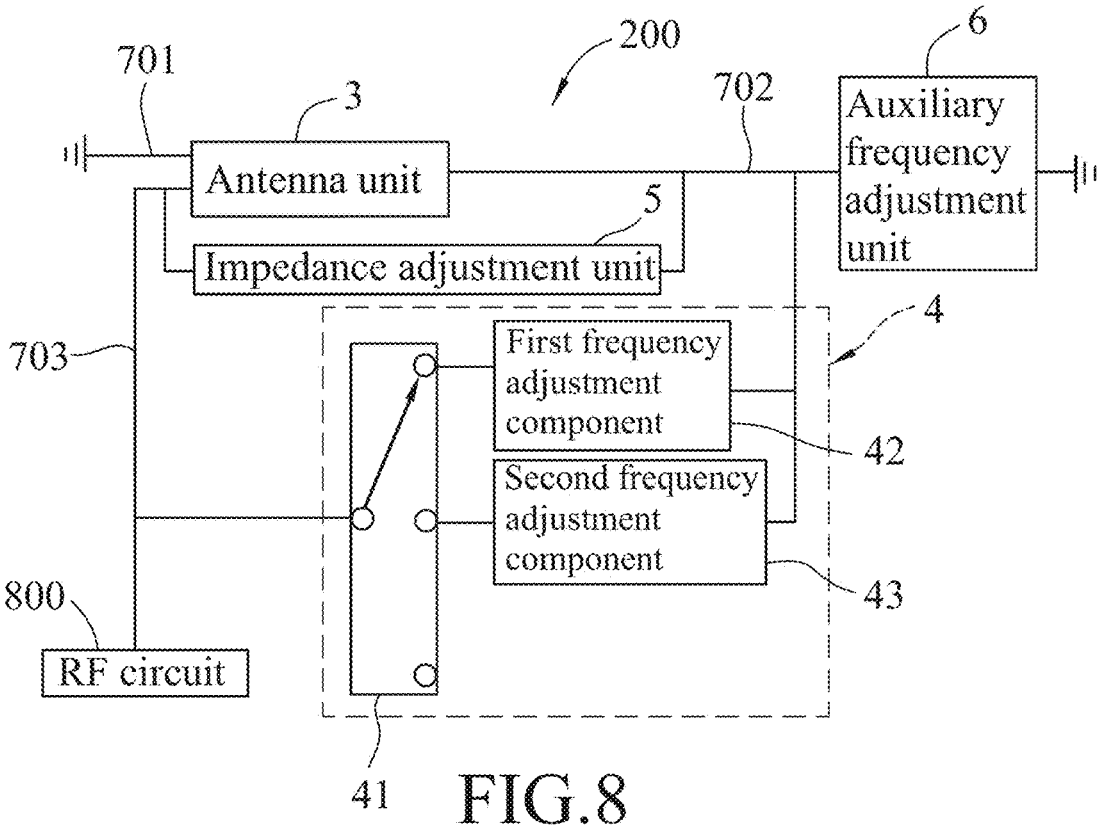
FIG. 8 is a circuit block diagram illustrating a variant of the third embodiment, a switching component of which is switched to a first state.
Figure 9:
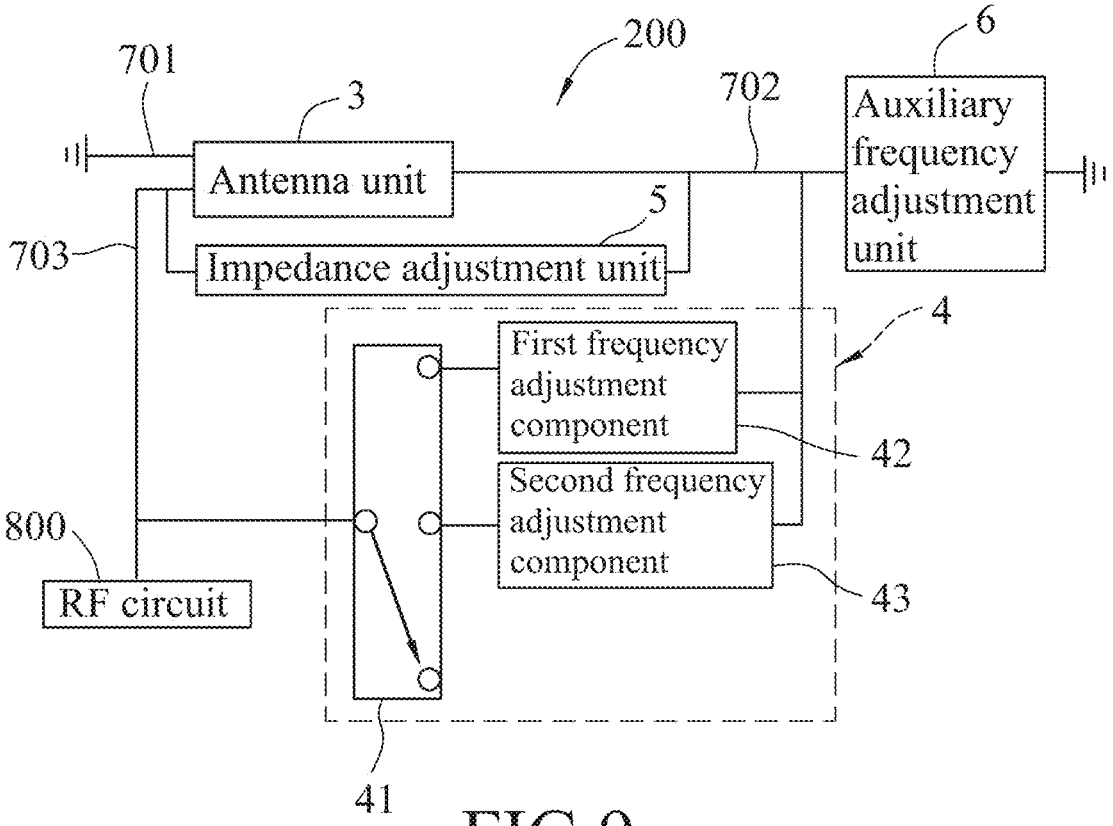
FIG. 9 is a circuit block diagram illustrating the variant of the third embodiment with the switching component switched to a third state.

Referring to FIGS. 8 and 9, a variant of the third embodiment of the multiple-frequency antenna device 200 is illustrated. The variant of the third embodiment does not include the third frequency adjustment component 44 (see FIG. 7). In the variant, when the switching component 41 is switched to the third state (see FIG. 9), the first frequency adjustment component 42 and the second frequency adjustment component 43 are both electrically disconnected from the feeding line 703, and the antenna unit 3, the frequency switch unit 4, the impedance adjustment unit 5 and the auxiliary frequency adjustment unit 6 are cooperatively resonant at the third resonant frequency. In this way, the multiple-frequency antenna device 200 is also capable of being switched to operate in one of three resonant frequencies.

Figure 10:
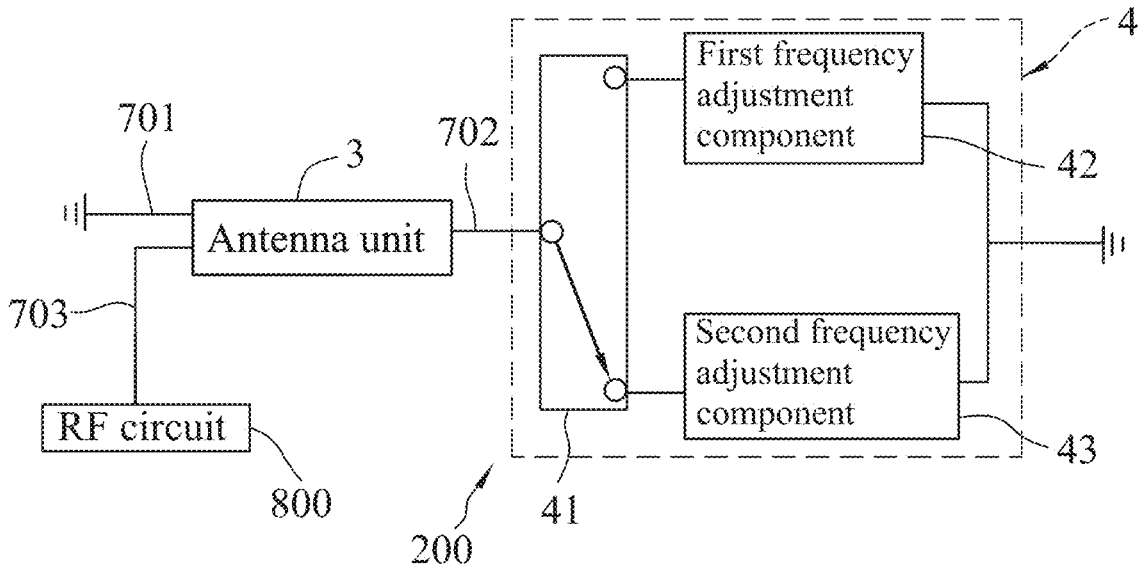
FIG. 10 is a circuit block diagram illustrating a fourth embodiment of the multiple-frequency antenna device according to the disclosure.

Referring to FIG. 10, a fourth embodiment of the multiple-frequency antenna device 200 is illustrated. The fourth embodiment is similar to the first embodiment, but is different in what are described as follows.

The first conductive layer 32 (see FIG. 3) of the antenna unit 3 of the fourth embodiment is electrically connected to ground via a first ground line 701, and is further electrically connected to the RF circuit 800 via a feeding line 703. The second conductive layer 33 (see FIG. 3) of the antenna unit 3 of the fourth embodiment is electrically connected to ground via a second ground line 702.

In the fourth embodiment, the frequency switch unit 4 includes a switching component 41, a first frequency adjustment component 42 and a second frequency adjustment component 43; the switching component 41 is switchable to a first state and to a second state; and both the first frequency adjustment component 42 and the second frequency adjustment component 43 are connected to ground.

When the switching component 41 is switched to the first state, the first frequency adjustment component 42 is electrically connected to the antenna unit 3 via the switching component 41 and the second ground line 702, and the antenna unit 3 and the frequency switch unit 4 are cooperatively resonant at a first resonant frequency. When the switching component 41 is switched to the second state, the second frequency adjustment component 43 is electrically connected to the antenna unit 3 via the switching component 41 and the second ground line 702, and the antenna unit 3 and the frequency switch unit 4 are cooperatively resonant at a second resonant frequency different from the first resonant frequency. In this way, the multiple-frequency antenna device 200 of the fourth embodiment is switchable to operate between two resonant frequencies.

Figure 11:
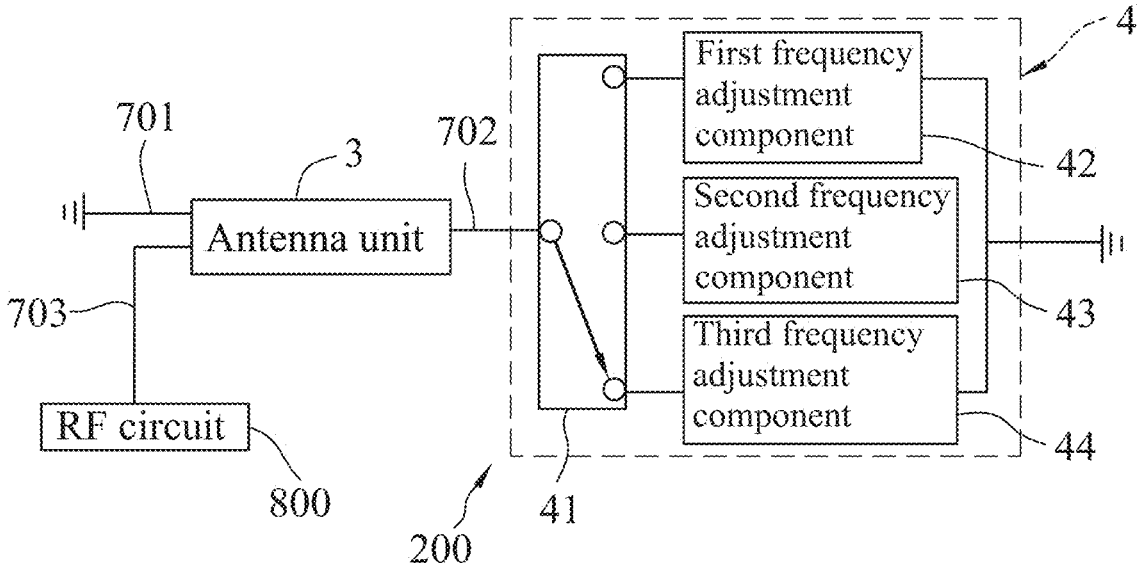
FIG. 11 is a circuit block diagram illustrating a fifth embodiment of the multiple-frequency antenna device according to the disclosure.

Referring to FIG. 11, a fifth embodiment of the multiple-frequency antenna device 200 is illustrated. The fifth embodiment is similar to the fourth embodiment, but is different in what are described as follows.

The frequency switch unit 4 of the fifth embodiment further includes a third frequency adjustment component 44 electrically connected to ground. Besides the first state and the second state described in the fourth embodiment, the switching component 41 is switchable further to a third state.

When the switching component 41 is switched to the third state, the third adjustment component 44 is electrically connected to the antenna unit 3 via the switching component 41 and the second ground line 702, and the antenna unit 3 and the frequency switch unit 4 are cooperatively resonant at a third resonant frequency different from the first and second resonant frequencies. The third resonant frequency may be adjusted by changing values of the capacitors, inductors and/or resistors that are utilized to implement the third frequency adjustment component 44.

Figure 12:
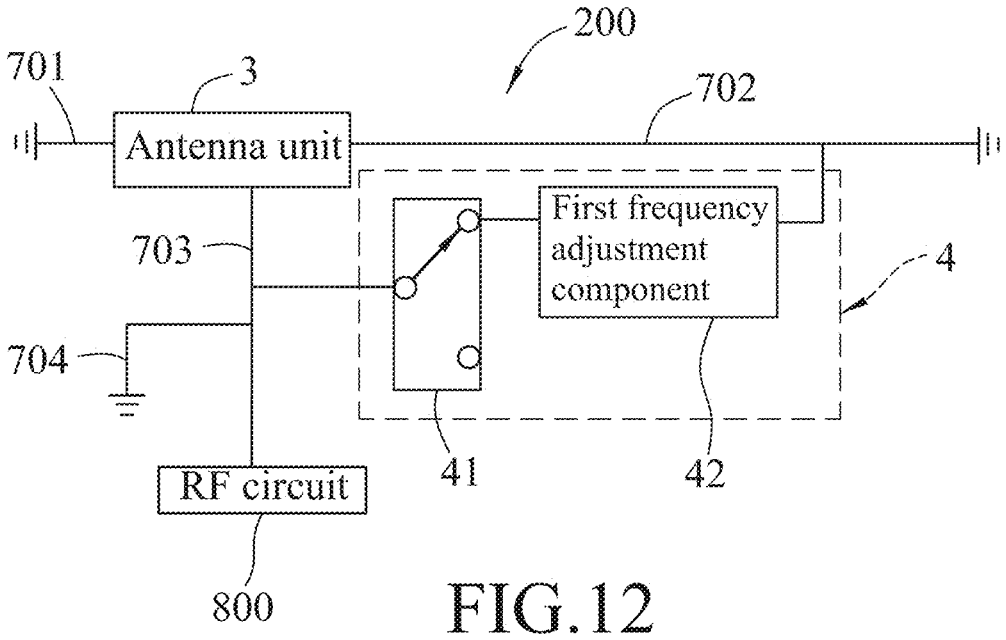
FIG. 12 is a circuit block diagram illustrating a sixth embodiment of the multiple-frequency antenna device according to the disclosure, a switching component of which is switched to a first state.
Figure 13:
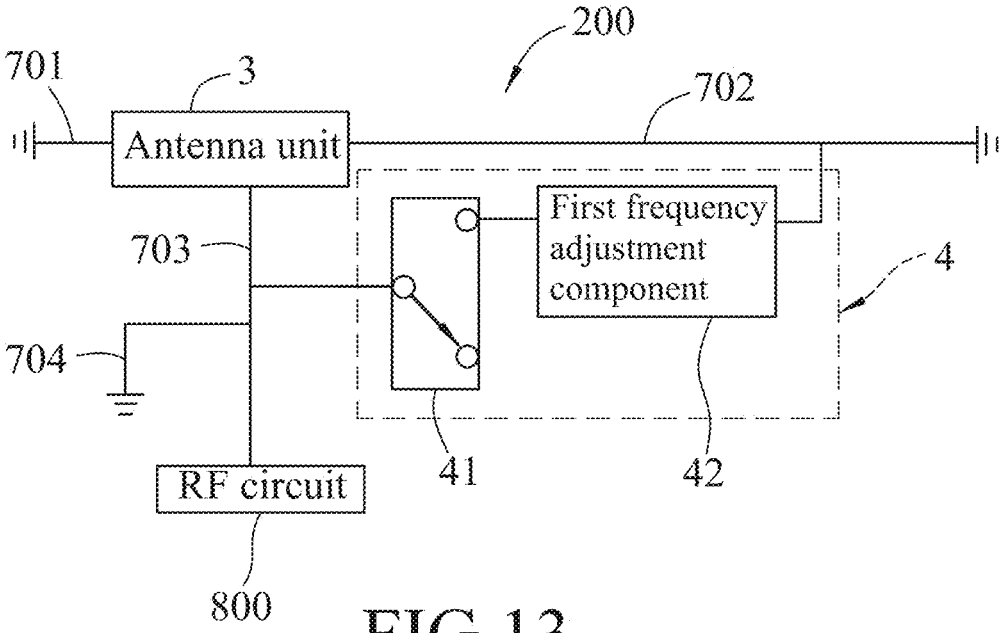
FIG. 13 is a circuit block diagram illustrating the sixth embodiment with the switching component switched to a second state.
Figure 14:
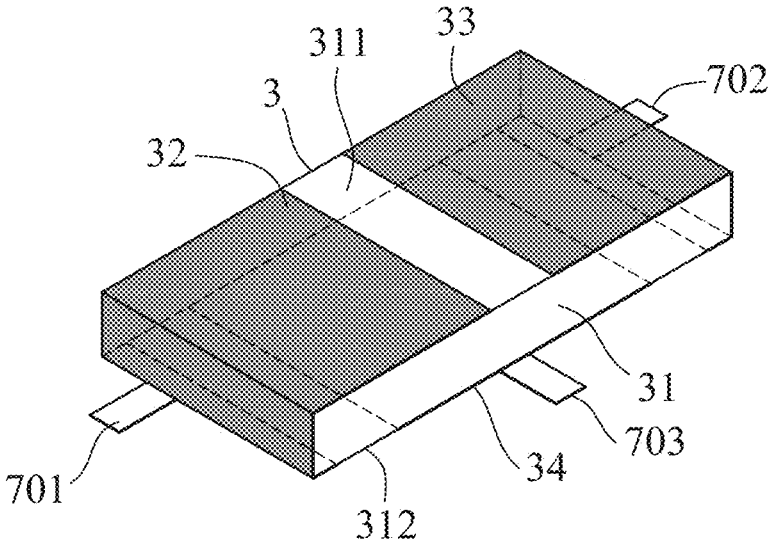
FIG. 14 is a perspective view illustrating an implementation of the antenna unit of the sixth embodiment.

Referring to FIGS. 12, 13 and 14, a sixth embodiment of the multiple-frequency antenna device 200 is illustrated. The sixth embodiment is similar to the first embodiment, but is different in what are described as follows.

As shown in FIG. 14, the antenna unit 3 of the sixth embodiment includes an insulating substrate 31, and a first conductive layer 32, a second conductive layer 33 and a third conductive layer 31 that are disposed on the insulating substrate 31. Specifically speaking, the insulating substrate 31 has a first surface 311 and a second surface 312 which are opposite to each other. The first conductive layer 32 and the second conductive layer 33 are disposed on the first surface 311 of the insulating substrate 31. The third conductive layer 34 is disposed on the second surface 312 of the insulating substrate 31. A projection of each of the first conductive layer 32 and the second conductive layer 33 on the second surface 312 of the insulating substrate 31 overlaps a portion of the third conductive layer 34. The first conductive layer 32 and the second conductive layer 33 are electrically connected to ground respectively via a first ground line 701 and a second ground line 702. The third conductive layer 34 is electrically connected to the RF circuit 800 via a feeding line 703 that is electrically connected to ground via a third ground line 704 as shown in FIGS. 12 and 13.

The frequency switch unit 4 is electrically connected to the antenna unit 3 in parallel via the second ground line 702 and the feeding line 703. The frequency switch unit 4 includes a first frequency adjustment component 42 and a switching component 41.

The first frequency adjustment component 42 is electrically connected to the antenna unit 3 via the second ground line 702. The first frequency adjustment component 42 may be implemented by passive components such as capacitors, inductors and/or resistors, but implementation of the first frequency adjustment component 42 is not limited to the disclosure herein and may vary in other embodiments.

The switching component 41 is switchable to a first state and to a second state. When the switching component 41 is switched to the first state, the first frequency adjustment component 42 is electrically connected to the antenna unit 3 via the switching component 41 and the feeding line 703 as shown in FIG. 12. At this time, the antenna unit 3 and the frequency switch unit 4 are cooperatively resonant at a first resonant frequency, and the antenna unit 3 is individually resonant at a second resonant frequency different from the first resonant frequency. When the switching component 41 is switched to the second state, the first frequency adjustment component 42 is electrically disconnected from the feeding line 703 as shown in FIG. 13. At this time, the antenna unit 3 and the frequency switch unit 4 are cooperatively resonant at a third resonant frequency different from the first and second resonant frequencies, and the antenna unit 3 is individually resonant at a fourth resonant frequency different from the first, second and third resonant frequencies.

Figure 15:
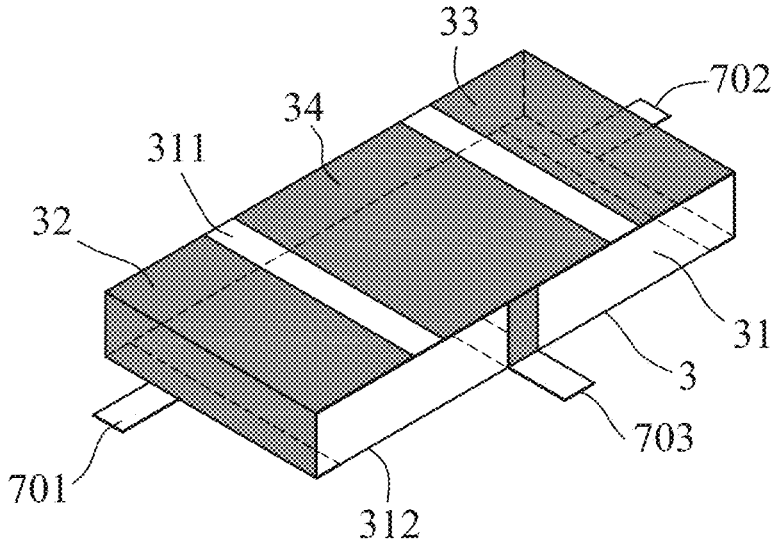
FIG. 15 is a perspective view illustrating another implementation of the antenna unit of the sixth embodiment.

Referring to FIG. 15, a variant of the sixth embodiment of the multiple-frequency antenna device 200 (see FIG. 12) is illustrated.

The antenna unit 3 of the variant includes an insulating substrate 31, and a first conductive layer 32, a second conductive layer 33 and a third conductive layer 34 that are disposed on the insulating substrate 31. Specifically speaking, the insulating substrate 31 has a first surface 311 and a second surface 312 which are opposite to each other. The first conductive layer 32, the second conductive layer 33, and the third conductive layer 34 are disposed on the same one of the first surface 311 and the second surface 312 of the insulating substrate 31. In this embodiment, the first conductive layer 32, the second conductive layer 33, and the third conductive layer 34 are all disposed on the first surface 311. In addition, the first conductive layer 32, the second conductive layer 33, and the third conductive layer 34 are separated and spaced apart from each other as shown in FIG. 15. In other words, there is a gap between the first conductive layer 32 and the third conductive layer 34, and there is another gap between the second conductive layer 33 and the third conductive layer 34. The first conductive layer 32 and the second conductive layer 33 are electrically connected to ground respectively via a first ground line 701 and a second ground line 702. The third conductive layer 34 is electrically connected to the RF circuit 800 (see FIG. 12) via a feeding line 703 that is electrically connected to ground via a third ground line 704 (see FIG. 12).

Referring back to FIGS. 12 and 13, when the switching component 41 is switched to either of the first state and the second state, the multiple-frequency antenna device 200 is capable of being resonant at two resonant frequencies for wireless communication and data transmission. Changing values of the capacitors, inductors and/or resistors of the first frequency adjustment component 42 enables the first, second, third and fourth resonant frequencies of the multiple-frequency antenna device 200 to be tuned based on demand.

Figure 16:
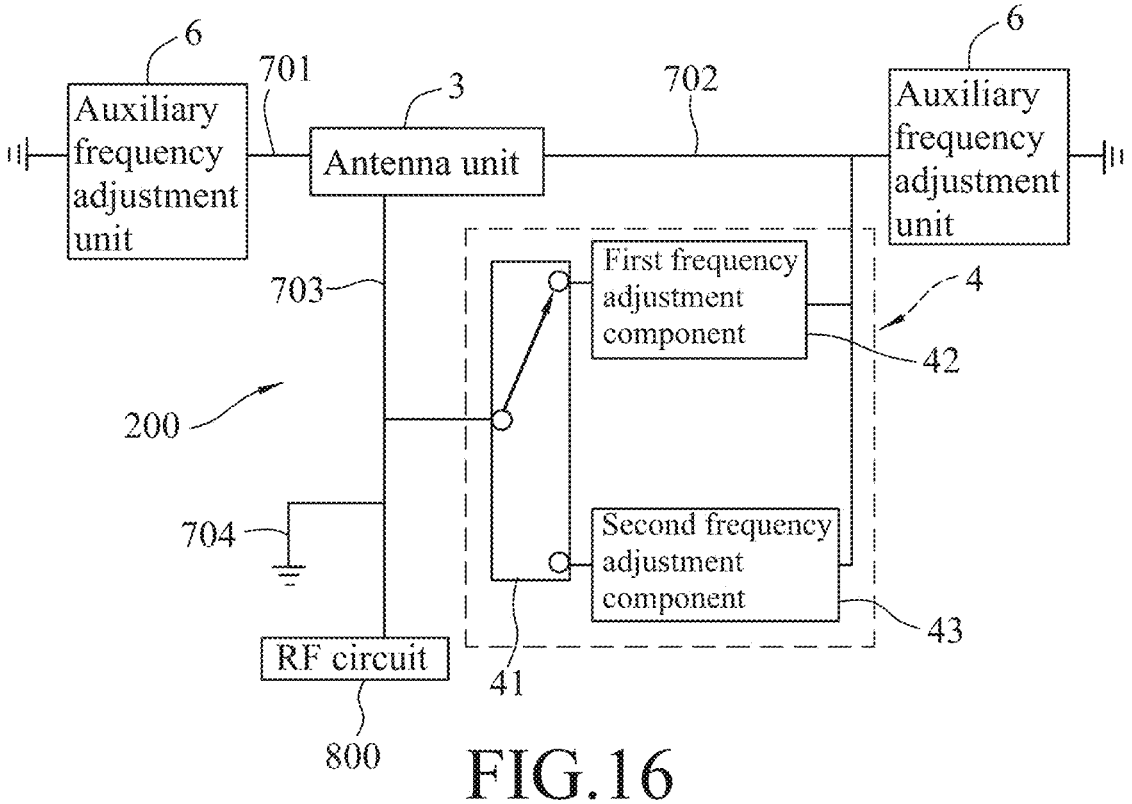
FIG. 16 is a circuit block diagram illustrating a seventh embodiment of the multiple-frequency antenna device according to the disclosure.

Referring to FIG. 16, a seventh embodiment of the multiple-frequency antenna device 200 is illustrated. The seventh embodiment is similar to the sixth embodiment, but is different in what are described as follows.

The multiple-frequency antenna device 200 of the seventh embodiment further includes two auxiliary frequency adjustment units 6, and the frequency switch unit 4 of the seventh embodiment further includes a second frequency adjustment component 43 electrically connected to the antenna unit 3 via the second ground line 702.

In this embodiment, one of said two auxiliary frequency adjustment units 6 is electrically connected between the first, ground line 701 and ground, and the other one of said two auxiliary frequency adjustment units 6 is electrically connected between the second ground line 702 and ground.

The second frequency adjustment component 43 and said two auxiliary frequency adjustment units 6 may each be implemented by passive components such as capacitors, inductors and/or resistors, but implementations of the second frequency adjustment component 43 and said two auxiliary frequency adjustment units 6 are not limited to the disclosure herein and may vary in other embodiments.

When the switching component 41 is switched to the first state, the first frequency adjustment component 42 is electrically connected to the antenna unit 3 via the switching component 41 and the feeding line 703; the antenna unit 3, the frequency switch unit 4, and one of the auxiliary frequency adjustment units 6 that is connected via the second ground line 702 to the antenna unit 3 are cooperatively resonant at a first resonant frequency; and the antenna unit 3 and the other one of the auxiliary frequency adjustment units 6 that is connected via the first ground line 701 to the antenna unit 3 are cooperatively resonant at a second resonant frequency.

When the switching component 41 is switched to the second state, the first frequency adjustment component 42 is electrically disconnected from the feeding line 703, and the second frequency adjustment component 43 is electrically connected to the antenna unit 3 via the switching component 41 and the feeding line 703. At this time, the antenna unit 3, the frequency switch unit 4, and said one of the auxiliary frequency adjustment units 6 that is connected via the second ground line 702 to the antenna unit 3 are cooperatively resonant at a third resonant frequency; and the antenna unit 3 and said the other one of the auxiliary frequency adjustment units 6 that is connected via the first ground line 701 to the antenna unit 3 are cooperatively resonant at a fourth resonant frequency.

The first and third resonant frequencies of the multiple-frequency antenna device 200 may be adjusted by changing values of the capacitors, inductors and/or resistors that are utilized to implement the first and second frequency adjustment components 42, 43 and said one of said two auxiliary frequency adjustment units 6 that is electrically connected between the second ground line 702 and ground. Similarly, the second and fourth resonant frequencies of the multiple-frequency antenna device 200 may be adjusted by changing values of the capacitors, inductors and/or resistors that are utilized to implement said the other one of said two auxiliary frequency adjustment units 6 that is electrically connected between the first ground line 701 and ground.

In a variant of the seventh embodiment of the multiple-frequency antenna device 200 according to the disclosure, inclusion of the auxiliary frequency adjustment units 6 is optional. In other words, the multiple-frequency antenna device 200 may be implemented to include one or no auxiliary frequency adjustment unit 6. For the embodiment where the multiple-frequency antenna device 200 includes no auxiliary frequency adjustment unit 6, the resonant frequencies may be adjusted through the first frequency adjustment component 42 and the second frequency adjustment component 43. For the embodiment where the multiple-frequency antenna device 200 includes the auxiliary frequency adjustment unit 6 that is electrically connected between the second ground line 702 and ground, the first and third resonant frequencies may be adjusted through the auxiliary frequency adjustment unit 6 that is electrically connected between the second ground line 702 and ground. For the embodiment where the multiple-frequency antenna device 200 includes the auxiliary frequency adjustment unit 6 that is electrically connected between the first ground line 701 and ground, the second and fourth resonant frequencies may be adjusted through the auxiliary frequency adjustment unit 6 that is electrically connected between the first ground line 701 and ground.

Figure 17:
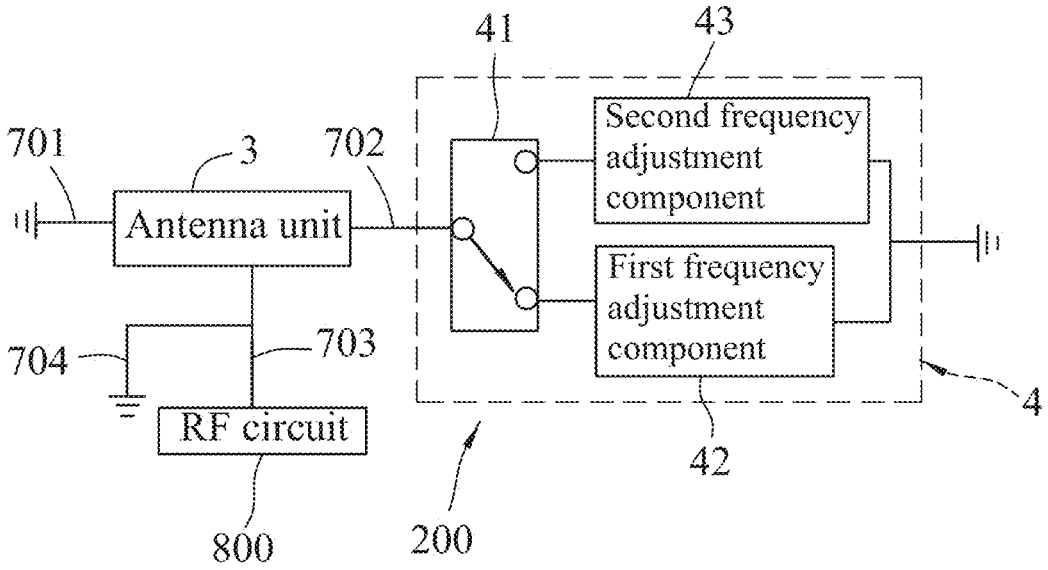
FIG. 17 is a circuit block diagram illustrating an eighth embodiment of the multiple-frequency antenna device according to the disclosure.

Referring to FIG. 17, an eighth embodiment of the multiple-frequency antenna device 200 is illustrated. The eighth embodiment as similar to the seventh embodiment, but is different in what are described as follows.

In this embodiment, the multiple-frequency antenna device 200 does not include the auxiliary frequency adjustment units (see FIG. 16); the first conductive layer 32 (see FIG. 14) of the antenna unit 3 is electrically connected to ground via a first ground line 701; the second conductive layer 33 (see FIG. 14) of the antenna unit 3 is electrically connected to ground via a second ground line 702; and the third conductive layer 34 (see FIG. 14) of the antenna unit 3 is electrically connected to the RF circuit 800 via a feeding line 703 that is electrically connected to ground via a third ground line 704.

The frequency switch unit 4 of the eighth embodiment includes a first frequency adjustment component 42, a second frequency adjustment component 43 and a switching component 41.

The first frequency adjustment component 42 is electrically connected between ground and the switching component 41. The second frequency adjustment component 43 is electrically connected between ground and the switching component 41. The switching component 41 is switchable to a first state and to a second state.

When the switching component 41 is switched to the first state, the first frequency adjustment component 42 is electrically connected to the antenna unit 3 via the switching component 41 and the second ground line 702, such that the antenna unit 3 and the frequency switch unit 4 are cooperatively resonant at a first resonant frequency, and that the antenna unit 3 is individually resonant at a second resonant frequency.

When the switching component 41 is switched to the second state, the second frequency adjustment component 43 is electrically connected to the antenna unit 3 via the switching component 41 and the second ground line 702, such that the antenna unit 3 and the frequency switch unit 4 are cooperatively resonant at a third resonant frequency, and that the antenna unit 3 is individually resonant at a fourth resonant frequency.

When the switching component 4 is switched to either of the first state and the second state, the multiple-frequency antenna device 200 is capable of being resonant at two resonant frequencies for wireless communication and data transmission. Changing values of the capacitors, inductors and/or resistors that are utilized to implement the first frequency adjustment component 42 and the second frequency adjustment component 43 enables the first and third resonant frequencies of the multiple-frequency antenna device 200 to be tuned based on demand.

Figure 18:
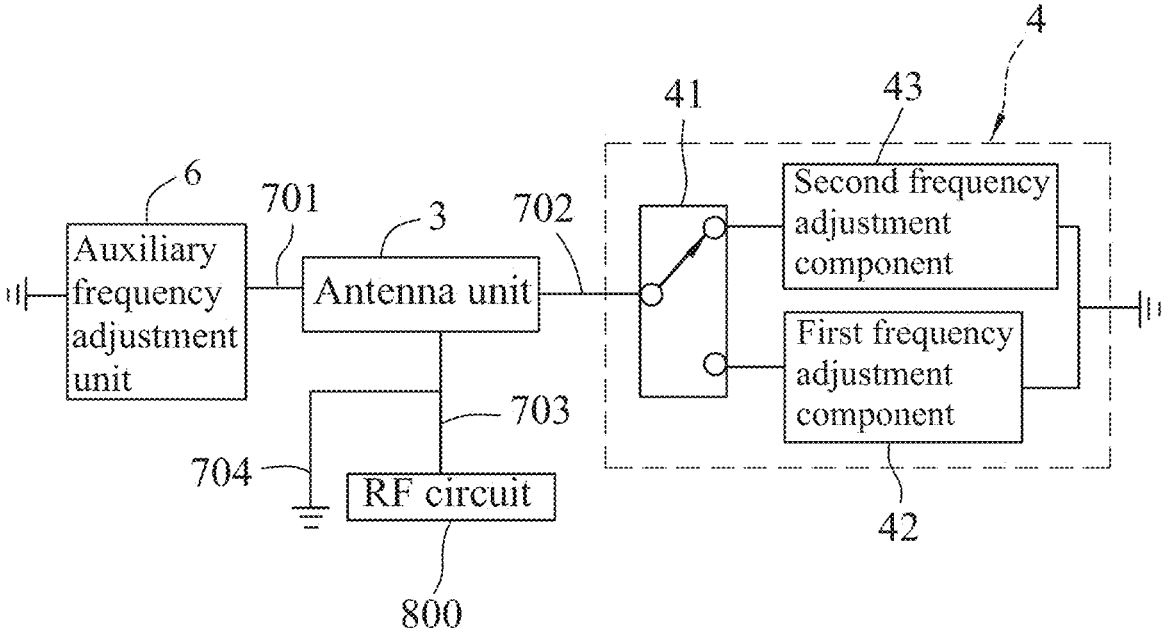
FIG. 18 is a circuit block diagram illustrating a ninth embodiment of the multiple-frequency antenna device according to the disclosure.

Referring to FIG. 18, a ninth embodiment of the multiple-frequency antenna device 200 is illustrated. The ninth embodiment is similar to the eighth embodiment, but is different in what are described as follows.

The multiple-frequency antenna device 200 of the ninth embodiment further includes an auxiliary frequency adjustment unit 6 that is electrically connected between the first ground line 701 and ground, and that enables adjustment of the second and fourth resonant frequencies of the multiple-frequency antenna device 200. The auxiliary frequency adjustment unit 6 may be implemented by passive components such as capacitors, inductors and/or resistors, but implementation of the auxiliary frequency adjustment unit 6 is not limited to the disclosure herein and may vary in other embodiments. The second and fourth resonant frequencies of the multiple-frequency antenna device 200 may be adjusted by changing values of the capacitors, inductors and/or resistors of the auxiliary frequency adjustment unit 6.

In summary, the multiple-frequency antenna device 200 according to the disclosure utilizes the frequency switch unit 4 to switch to different states so as to enable the antenna unit 3 and the frequency switch unit 4 to be resonant at different resonant frequencies, which correspond to different wireless communication technologies. Therefore, electronic devices utilizing the multiple-frequency antenna device 200 of this disclosure is capable of performing wireless communication or data transmission in different frequency bands. In addition, resonant frequencies of the multiple-frequency antenna device 200 are adjustable as demanded by implementing the first frequency adjustment component 42, second frequency adjustment component 43, the third frequency adjustment component 44, the impedance adjustment unit 5 and/or the auxiliary frequency adjustment units 6 with appropriate values of capacitors, inductors and/or resistors.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A multiple-frequency antenna device, adapted to be electrically connected to a radio-frequency (RF) circuit, said multiple-frequency antenna device comprising:

an antenna unit including an insulating substrate, and a first conductive layer and a second conductive layer that are disposed on said insulating substrate, said first and second conductive layers being electrically connected to ground respectively via a first ground line and a second ground line, said first conductive layer being further electrically connected to the RF circuit via a feeding line; and a frequency switch unit electrically connected to said antenna unit in parallel via the second ground line and the feeding line, and including a first frequency adjustment component electrically connected to said antenna unit via the second ground line, and a switching component that is switchable at least to a first state and to a second state, wherein, when said switching component is switched to the first state, said first frequency adjustment component is electrically connected to said antenna unit via said switching component and the feeding line, and said antenna unit and said frequency switch unit are cooperatively resonant at a first resonant frequency, wherein, when said switching component is switched to the second state, said first frequency adjustment component is electrically disconnected from the feeding line, and said antenna unit and said frequency switch unit are cooperatively resonant at a second resonant frequency different from the first resonant frequency.

2. The multiple-frequency antenna device as claimed in claim 1, wherein:

said frequency switch unit further includes a second frequency adjustment component electrically connected to said antenna unit via the second ground line; and when said switching component is switched to the second state, said second frequency adjustment component is electrically connected to said antenna unit via said switching component and the feeding line, and said antenna unit and said frequency switch unit are cooperatively resonant at the second resonant frequency different from the first resonant frequency.

3. The multiple-frequency antenna device as claimed in claim 2, wherein:

said switching component is switchable further to a third state; and when said switching component is switched to the third state, said first frequency adjustment component and said second frequency adjustment component are both electrically disconnected from the feeding line, and said antenna unit and said frequency switch unit are cooperatively resonant at a third resonant frequency different from the first and second resonant frequencies.

4. The multiple-frequency antenna device as claimed in claim 3, wherein:

said frequency switch unit further includes a third frequency adjustment component electrically connected to said antenna unit via the second ground line; and when said switching component is switched to the third state, said third frequency adjustment component is electrically connected to said antenna unit via said switching component and the feeding line, and said antenna unit and said frequency switch unit are cooperatively resonant at the third resonant frequency different from the first and second resonant frequencies.

5. The multiple-frequency antenna device as claimed in claim 1, further comprising an impedance adjustment unit electrically connected to said antenna unit in parallel via the second ground line and the feeding line so that an effective impedance of said multiple-frequency antenna device can be tuned by said impedance adjustment unit.

6. The multiple-frequency antenna device as claimed in claim 1, further comprising an auxiliary frequency adjustment unit that is electrically connected between the second ground line and ground and that enables adjustment of the first and second resonant frequencies of said multiple-frequency antenna device.

7. The multiple-frequency antenna device as claimed in claim 1, wherein:

said insulating substrate has a first surface; and said first conductive layer and said second conductive layer are disposed on said first surface of said insulating substrate, and are spaced apart from each other.

8. The multiple-frequency antenna device as claimed in claim 1, wherein:

said insulating substrate has a first surface and a second surface which are opposite to each other;

said first conductive layer is disposed on said first surface of said insulating substrate;

said second conductive layer is disposed on said second surface of said insulating substrate;

a projection of said first conductive layer on said second surface of said insulating substrate overlaps a portion of said second conductive layer.

9. A multiple-frequency antenna device, adapted to be electrically connected to a radio-frequency (RF) circuit, said multiple-frequency antenna device comprising:

an antenna unit including an insulating substrate, and a first conductive layer and a second conductive layer that are disposed on said insulating substrate, said first conductive layer being electrically connected to ground via a first ground line, and being further electrically connected to the RF circuit via a feeding line, said second conductive layer being electrically connected to ground via a second ground line; and a frequency switch unit including a first frequency adjustment component electrically connected to ground, a second frequency adjustment component electrically connected to ground, and a switching component that is switchable at least to a first state and to a second state, wherein, when said switching component is switched to the first state, said first frequency adjustment component is electrically connected to said antenna unit via said switching component and the second ground line, and said antenna unit and said frequency switch unit are cooperatively resonant at a first resonant frequency, wherein, when said switching component is switched to the second state, said second frequency adjustment component is electrically connected to said antenna unit via said switching component and the second ground line, and said antenna unit and said frequency switch unit are cooperatively resonant at a second resonant frequency different from the first resonant frequency.

10. The multiple-frequency antenna device as claimed in claim 9, wherein:

said frequency switch unit further includes a third frequency adjustment component electrically connected to ground;

said switching component is switchable further to a third state; and when said switching component is switched to the third state, said third frequency adjustment component is electrically connected to said antenna unit via said switching component and the second ground line, and said antenna unit and said frequency switch unit are cooperatively resonant at a third resonant frequency different from the first and second resonant frequencies.

11. The multiple-frequency antenna device as claimed in claim 9, wherein:

said insulating substrate has a first surface; and said first conductive layer and said second conductive layer are disposed on said first surface of said insulating substrate, and are spaced apart from each other.

12. The multiple-frequency antenna device as claimed in claim 9, wherein:

said insulating substrate has a first surface and a second surface which are opposite to each other;

said first conductive layer is disposed on said first surface of said insulating substrate;

said second conductive layer is disposed on said second surface of said insulating substrate;

a projection of said first conductive layer on said second surface of said insulating substrate overlaps a portion of said second conductive layer.

13. A multiple-frequency antenna device, adapted to be electrically connected to a radio-frequency (RF) circuit, said multiple-frequency antenna device comprising:

an antenna unit including an insulating substrate, and a first conductive layer, a second conductive layer and a third conductive layer that are disposed on said insulating substrate, said first conductive layer and said second conductive layer being electrically connected to ground respectively via a first ground line and a second ground line, said third conductive layer being electrically connected to the RF circuit via a feeding line that is electrically connected to ground via a third ground line; and a frequency switch unit electrically connected to said antenna unit in parallel via the second ground line and the feeding line, and including a first frequency adjustment component electrically connected to said antenna unit via the second ground line, and a switching component that is switchable to a first state and to a second state, wherein, when said switching component is switched to the first state, said first frequency adjustment component is electrically connected to said antenna unit via said switching component and the feeding line, said antenna unit and said frequency switch unit are cooperatively resonant at a first resonant frequency, and said antenna unit is individually resonant at a second resonant frequency different from the first resonant frequency, and wherein, when said switching component is switched to the second state, said first frequency adjustment component is electrically disconnected from the feeding line, said antenna unit and said frequency switch unit are cooperatively resonant at a third resonant frequency different from the first and second resonant frequencies, and said antenna unit is individually resonant at a fourth resonant frequency different from the first, second and third resonant frequencies.

14. The multiple-frequency antenna device as claimed in claim 13, wherein:

said frequency switch unit further includes a second frequency adjustment component electrically connected to said antenna unit via the second ground line; and when said switching component is switched to the second state, said second frequency adjustment component is electrically connected to said antenna unit via said switching component and the feeding line.

15. The multiple-frequency antenna device as claimed in claim 13, further comprising an auxiliary frequency adjustment unit that is electrically connected between the second ground line and ground and that enables adjustment of the first and third resonant frequencies of said multiple-frequency antenna device.

16. The multiple-frequency antenna device as claimed in claim 13, further comprising an auxiliary frequency adjustment unit that is electrically connected between the first ground line and ground and that enables adjustment of the second and fourth resonant frequencies of said multiple-frequency antenna device.

17. The multiple-frequency antenna device as claimed in claim 13, wherein:

said insulating substrate has a first surface and a second surface which are opposite to each other;

said first conductive layer and said second conductive layer are disposed on said first surface of said insulating substrate;

said third conductive layer is disposed on said second surface of said insulating substrate;

a projection of each of said first conductive layer and said second conductive layer on said second surface of said insulating substrate overlaps a portion of said third conductive layer.

18. A multiple-frequency antenna device, adapted to be electrically connected to a radio-frequency (RF) circuit, said multiple-frequency antenna device comprising:

an antenna unit and a frequency switch unit;

said antenna unit including an insulating substrate, and a first conductive layer, a second conductive layer and a third conductive layer that are disposed on said insulating substrate, said first conductive layer being electrically connected to ground via a first ground line, said second conductive layer being electrically connected to ground via a second ground line, said third conductive layer being electrically connected to the RF circuit via a feeding line that is electrically connected to ground via a third ground line;

said frequency switch unit including a first frequency adjustment component electrically connected to ground, a second frequency adjustment component electrically connected to ground, and a switching component that is switchable to a first state and to a second state, wherein, when said switching component is switched to the first state, said first frequency adjustment component is electrically connected to said antenna unit via said switching component and the second ground line, said antenna unit and said frequency switch unit are cooperatively resonant at a first resonant frequency, and said antenna unit is individually resonant at a second resonant frequency different from the first resonant frequency, and wherein, when said switching component is switched to the second state, said second frequency adjustment component is electrically connected to said antenna unit via said switching component and the second ground line, said antenna unit and said frequency switch unit are cooperatively resonant at a third resonant frequency different from the first and second resonant frequencies, and said antenna unit is individually resonant at a fourth resonant frequency different from the first, second and third resonant frequencies.

19. The multiple-frequency antenna device as claimed in claim 18, further comprising an auxiliary frequency adjustment unit that is electrically connected between the first ground line and ground and that enables adjustment of the second and fourth resonant frequencies of said multiple-frequency antenna device.

20. The multiple-frequency antenna device as claimed in claim 18, wherein:

said insulating substrate has a first surface and a second surface which are opposite to each other;

said first conductive layer and said second conductive layer are disposed on said first surface of said insulating substrate;

said third conductive layer is disposed on said second surface of said insulating substrate;

a projection of each of said first conductive layer and said second conductive layer on said second surface of said insulating substrate respectively overlaps a portion of said third conductive layer.

* * * * *